US006324984B1

(12) United States Patent
Dindl

(10) Patent No.: US 6,324,984 B1
(45) Date of Patent: Dec. 4, 2001

(54) PAYLOAD MECHANISM FOR LOW IMPULSE CARTRIDGES

(75) Inventor: Frank J. Dindl, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/632,009

(22) Filed: Aug. 3, 2000

Related U.S. Application Data

(60) Provisional application No. 60/149,859, filed on Aug. 20, 1999.

(51) Int. Cl.[7] ..... F42B 3/00; F42B 3/06

(52) U.S. Cl. ..... 102/447; 102/447; 102/444; 102/445; 102/446; 102/430; 102/464; 102/469; 102/470; 89/29

(58) Field of Search ..... 102/430, 444, 102/445–447, 464, 469–470; 89/29

(56) References Cited

U.S. PATENT DOCUMENTS

| | | | | |
|---|---|---|---|---|
| H000114 | * | 8/1986 | Quintavalle | 102/513 |
| 3,744,420 | * | 7/1973 | Barr . | |
| 4,686,905 | * | 8/1987 | Szabo | 102/444 |
| 4,862,805 | * | 9/1989 | Szabo | 102/444 |
| 5,359,937 | * | 11/1994 | Dittrich | 102/430 |
| 5,677,505 | * | 10/1997 | Dittrich | 89/29 |
| 5,834,681 | * | 11/1998 | DuBay | 102/430 |
| 5,938,773 | * | 11/1999 | Dionne | 89/29 |
| 6,095,051 | * | 8/2000 | Saxby | 102/444 |

* cited by examiner

*Primary Examiner*—Michael J. Carone
*Assistant Examiner*—Lulit Semunegus
(74) *Attorney, Agent, or Firm*—John F. Moran; Michael Sachs

(57) ABSTRACT

This low impulse payload cartridge for automatic weapons includes a case, a piston, an ogive, a payload cup, a payload, and a link. The payload cup and payload is seated into the forward portion of the piston. Gas passages permit propellant gases to bleed into the cavity behind the payload and to accelerate the payload upon firing. An alternative to using bleed gases is to use a separate propelling charge behind the payload. The case and piston are assembled and telescopically secured by means of a crimp or other similar feature, to allow relative movement therebetween during chambering and firing. The link may be allowed to move for some portion of the required relative travel between the link and the base of the case. A shoulder on the piston provides a stop through which reaction loads are transmitted to the rear of the barrel during chambering and firing. The piston telescopes over the case during chambering to provide the relative movement between the link and the case base required for weapon function. The relative movement between the piston and the case also allow the payload cup to be forced through the end of the piston. Upon firing, the expanding propellant gases force the case and piston to telescope open. Propellant gases are also used to expel the payload. Reaction loads are applied to the rear of the barrel through the shoulder, and at the same time are applied to a bolt, driving it rearward to cycle the weapon. The cartridge can be used in automatic weapon systems including but not limited to the 40 mm MK19 Grenade Machinegun.

9 Claims, 6 Drawing Sheets

PAYLOAD MECHANISM FOR LOW IMPULSE CARTRIDGES

RELATED APPLICATIONS

This application claims benefit of filing date Aug. 20, 1999 of provisional application 60/149,859, the entire file wrapper contents of which application are herewith incorporated by reference as though fully set forth herein at length.

U.S. GOVERNMENT INTEREST

The invention described herein may be manufactured, used, or licensed by or for the U.S. Government for U.S. Government purposes without the payment of any royalties thereon.

BACKGROUND OF THE INVENTION

I. Field of Invention

This invention applies to the field of weapons and cartridges which are capable of firing low impulse non-lethal payloads and other payloads from automatic weapons.

The present invention relates in general to the field of ammunition, and it particularly relates to a payload mechanism for low impulse cartridges used in automatic weapons. More specifically, the present invention relates to a low impulse payload cartridge for use in automatic weapon systems such as the 40 mm MK19 Grenade Machinegun, though the inventive concept is applicable to any caliber of weapon and ammunition. The present invention relates to co-pending U.S. patent application Ser. No. 09/351,978 now patented, U.S. Pat. No. 6,178,889 to Frank Dindl, titled "Low Impulse Telescoping Cartridge", filed on Jul. 12, 1999, and commonly assigned to the assignee of the present invention, which is incorporated herein in its entirety.

II. Background of the Invention

Payload type munitions (non-lethal multiple rubber balls, bean bags, foam batons, wood batons, etc.) have been mostly limited to single shot or manually operated weapons, with of course the exception of shotguns and other weapons purposely designed to work with shot shell cylindrical cartridges.

The U.S. Military, however, has the need to fire payload type munitions from such automatic weapons as the 40 mm MK19 Grenade Machine Gun. Such weapons fire lethal rounds which use rounded tips to provide reliable weapon function. On the other hand, payload type munitions require an opening in the tip of the cartridges to allow payloads to be launched.

Automatic weapons such as the 40 mm MK19 Grenade Machinegun are designed to use ammunition with a specific external envelope. The external dimensions of a payload cartridge must be compatible with the weapon from which it is fired. The cartridge configuration must also withstand the forces encountered during weapon feeding and cycling.

Additionally, the typical opening for launching a payload can be described as cylindrical. Since a simple cylindrical cartridge tip is normally not reliably compatible with most automatic weapon mechanisms, a cover must be provided to provide the necessary external cartridge dimensions and be robust to withstand the forces encountered during weapon operation. However, the cover must open on firing to allow the payload to be expelled.

In summary, there is a great and still unsatisfied need for a payload mechanism for low impulse cartridges used in automatic weapons. Exemplary payloads include liquids, solids and powders, and include nonlethal payloads such as rubber balls, wood batons, foam batons, and rubber projectiles. A need also exists for firing obscurant payloads, which are typically powdered materials.

Accordingly it is an object of this invention to provide the rounded nose configuration essential for reliable weapon function in weapons such as the 40 mm MK19GMG, while at the same time providing the requisite payload for launch.

Another object is to provide a low impulse payload cartridge with an external configuration which is compatible with conventional automatic weapon systems such as the 40 mm MK19 Grenade Machinegun.

Yet, another feature of the present invention is to provide an ammunition configuration that provides a cylindrical opening for launching the payload where the opening approaches the size of bore of the weapon barrel to allow for the launching of low velocity and/or low mass projectiles or payloads such as non-lethal multiple rubber balls, batons, rubber projectiles, powders, and a variety of other low impulse projectile configurations while functioning the MK19 Grenade Machinegun or other firearms in a fully automatic mode.

Finally, another feature of the present invention is to provide a fully automatic weapon function without requiring changes to the weapon itself, while permitting effective firing of reduced velocity and/or reduced mass projectiles. These and other features and advantages of the invention are achieved by a low impulse payload cartridge. Other objects of this invention will appear hereinafter.

SUMMARY OF INVENTION

It has now been discovered that the above and other objects of the present invention may be accomplished in the following manner. Specifically, the invention provides the rounded nose configuration essential for reliable weapon function with low impulse cartridges. This is accomplished upon chambering of the round of ammunition when the internal payload cup is forced through the nose, exposing the payload, allowing straight forward launch of the payload.

The cartridge configuration includes a payload mechanism which consists of a cup containing the payload. The cartridge nose configuration provides the external shape required for compatibility with the weapon while allowing the payload cup to pierce the cartridge nose upon firing to allow the launching of the payload.

During the operation of the 40 mm MK19 Grenade Machinegun using the cartridge of the present invention, the cartridge travels through the weapon feed mechanism. The outside configuration of the cartridge and the position of the link is preferably constrained to that of conventional ammunition to be compatible with the weapon. The link and cartridge are restrained during the delinking operation and cartridge pickup as the bolt reaches the battery position. As the bolt is returned rearward, the cartridge is cammed down the bolt face into alignment with the barrel. As the bolt moves forward to the battery position, the cartridge is chambered. Upon firing, the payload cup is forced through the nose of the cartridge by either the expanding propellant gases or telescoping action of the cartridge case. Expanding propellant gases from the primary propellant charge in the base of the cartridge case or from a secondary charge in the base of the payload cup propels the payload from the payload cup and launches the payload from the weapon. A shoulder on the outer surface of the payload cup stops against a mating surface on the inside of the piston to prevent the payload cup from being ejected during firing. Reaction loads are applied to the barrel through the shoulder and through the base of the cartridge to the bolt. The energy imparted to the bolt accelerates the bolt rearward and cycles the weapon.

The present invention enables the practical and efficient use of low impulse payload ammunition in an unmodified automatic weapon such as the MK19 Grenade Machinegun.

In one embodiment, the secondary propellant charge can be used as an alternative to bleeding propellant gases from the primary propellant charge, in order to accelerate the projectile.

BRIEF DESCRIPTION OF THE DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and for the purpose of explanation.

DETAILED DESCRIPTION OF THE PREFERRED EMBODIMENTS

Figure 1:
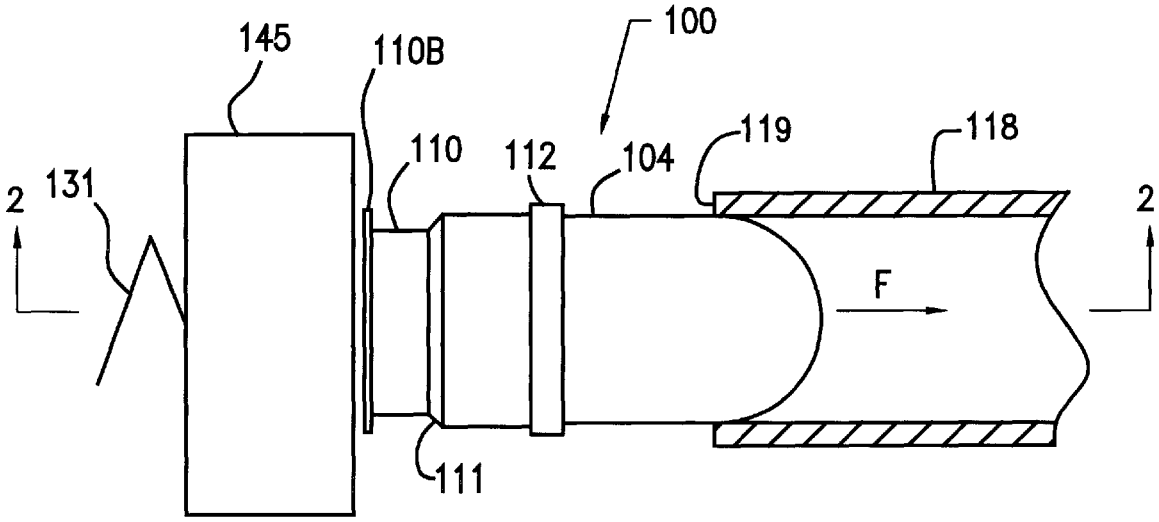
FIG. 1 is a side elevational view of a low impulse payload cartridge according to the present invention.
Figure 2:
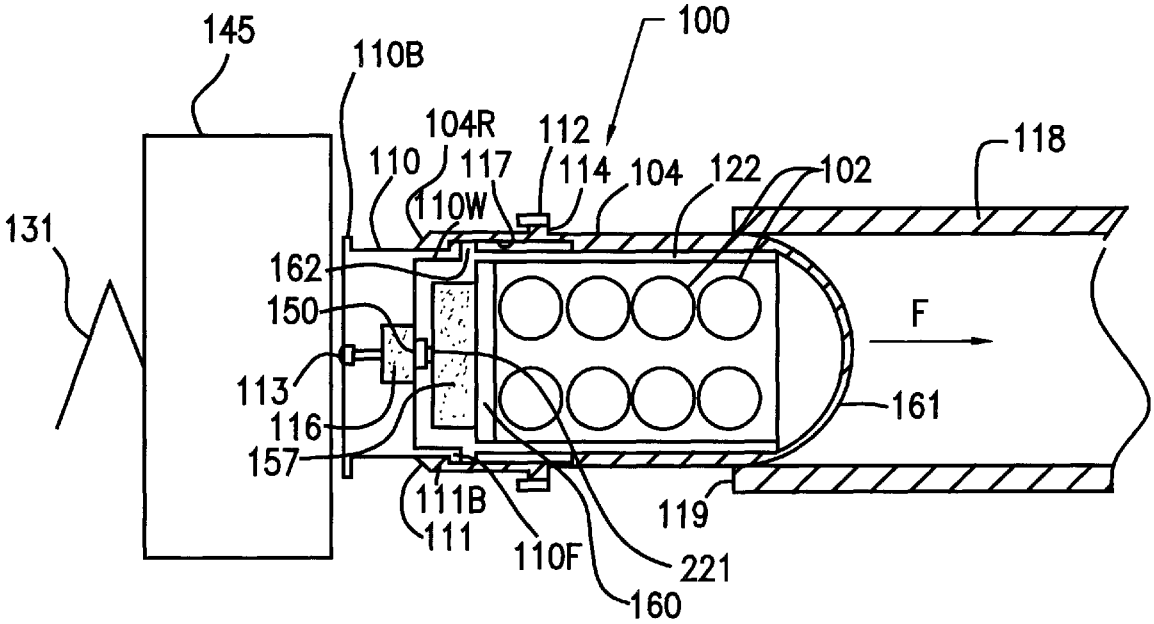
FIG. 2 is a cross-sectional view of the payload cartridge of FIG. 1 taken along line 2—2, for illustrating the cartridge configuration during feeding prior to chambering.
Figure 3:
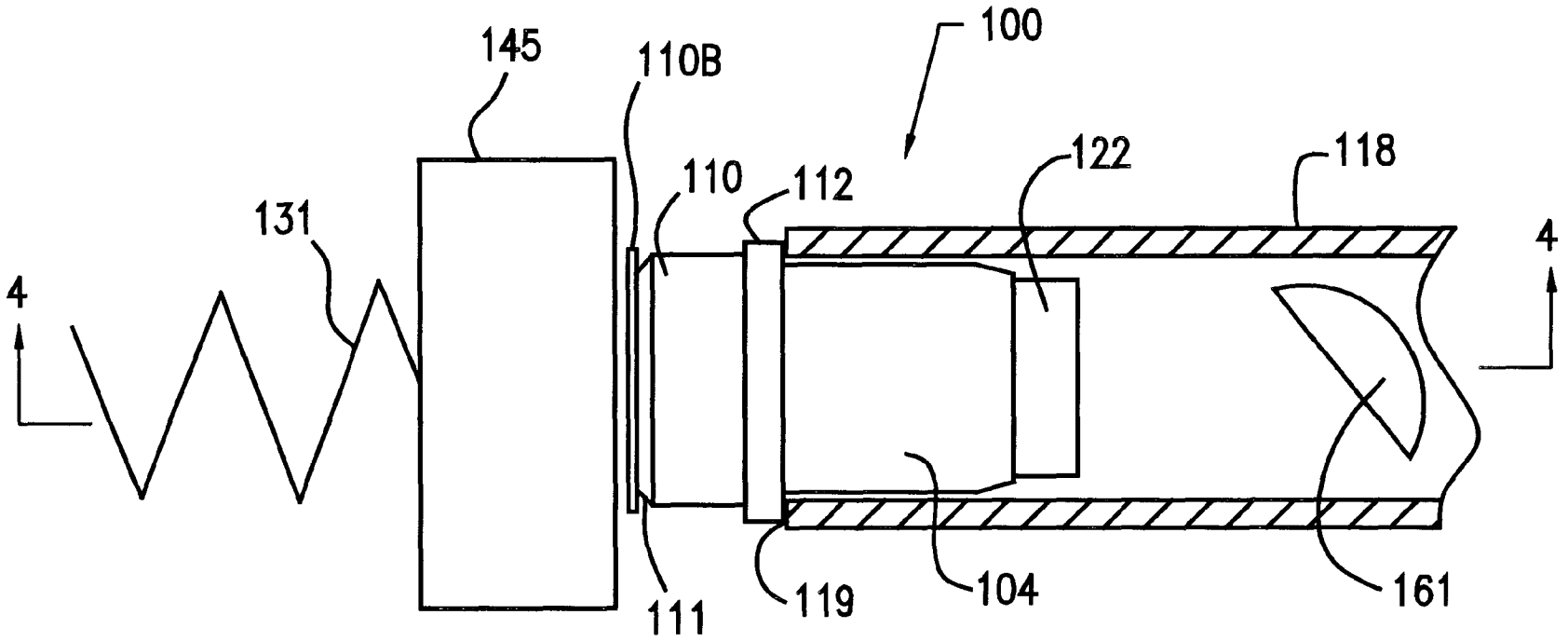
FIG. 3 is a side elevational view of the cartridge of FIGS. 1 and 2, shown fully chambered where the payload cup has pierced the tip of the cartridge to allow ejection of the payload.

A low impulse, telescoping cartridge 100 according to a first embodiment of the present invention is depicted in FIGS. 1 through 6. With particular reference to FIGS. 1, 2 and 3, the cartridge 100 is generally comprised of five main components; a projectile or payload 102, a cup 122, a piston 104, a case 110, and a link 112. The cartridge case 110 contains a primer 113 to provide ignition. A propellant 116 provides the required propulsion energy to function a weapon. A crimp 111 or another similar or equivalent feature secures the case 110 relative to the piston 104 in such a manner that allows for the cartridge 100 telescoping function, that prevents the case 110 from separating from the piston 104, and that further prevents cartridge telescoping during the delinking process while feeding. The overall outer configuration of the cartridge 100 matches the outer configuration of a conventional ammunition where the cartridge interfaces with the weapon, to the extent necessary for reliable weapon operation.

The cartridge case 110 fits into the rear portion 104R of the piston 104 such that a portion of the outer wall 110W of the cartridge case 110 mates with the inner wall 117 of the piston 104 to provide a seal for containing the propellant gases. The piston 104 further includes a shoulder 114 that protrudes outwardly from the periphery of the piston 104 to provide a stop for the barrel 118 when the cartridge 100 is fully chambered. The shoulder 114 limits the travel distance of the piston 104 within the barrel 118. The shoulder 114 also provides a mechanism through which the reaction forces are transmitted from the piston 104 to the rear surface or breech 119 of the barrel 118.

Figure 4:
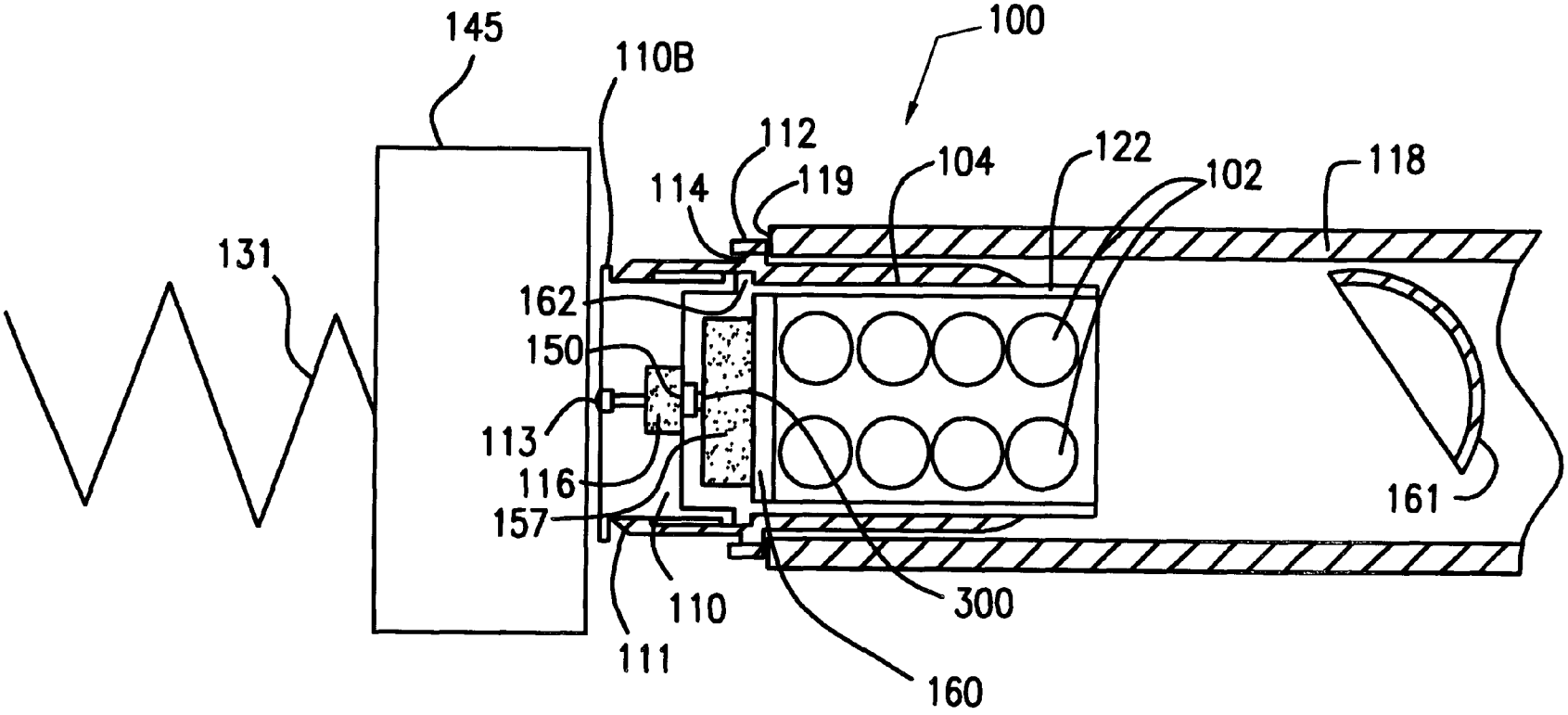
FIG. 4 is a cross-sectional view of the cartridge of FIG. 3 taken along line 4—4.

As FIGS. 3 and 4 show, during chambering, the case 110 is forced into the piston 104. The case 110 forces the cup 122 forward and through the end of the piston 104 to create an opening through which the payload 102 may be ejected.

Figure 5:
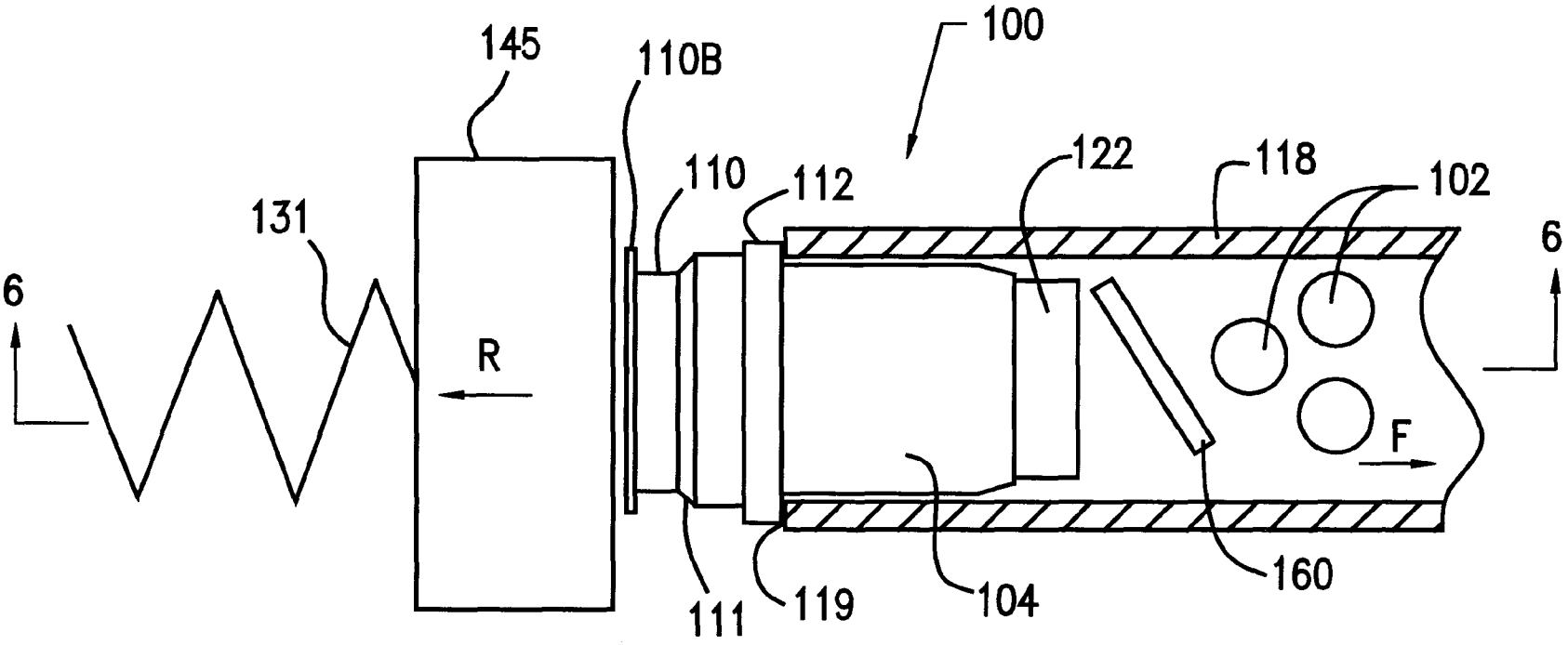
FIG. 5 is a side elevational view of the cartridges of FIGS. 3–4, shown after firing.
Figure 6:
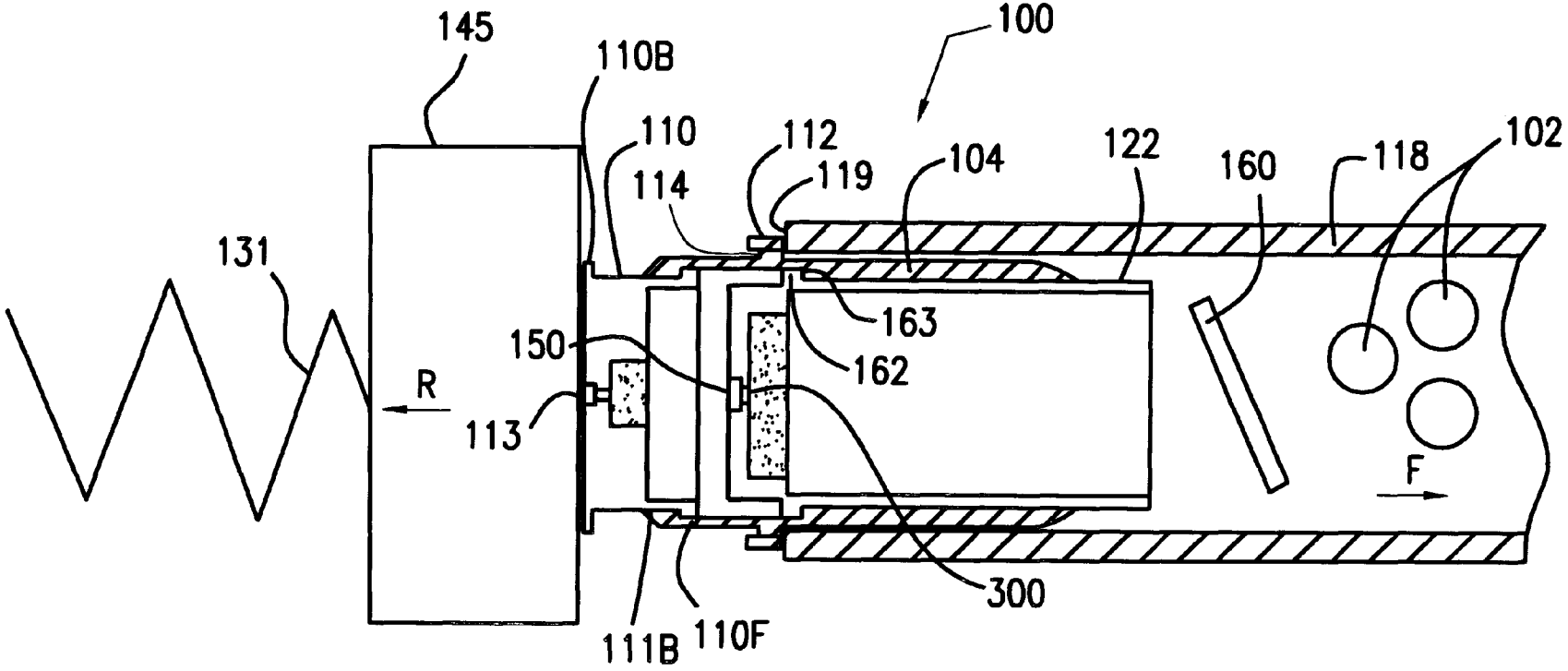
FIG. 6 is cross-sectional view of the cartridge of FIG. 5, shown after firing, taken along line 6—6.

From FIG. 5, during firing, the expanding propelling gases force the piston 104 to telescope open relative to the case 110. Now FIG. 6 shows the shoulder 114 provides the load path for reacting against the barrel 118. Simultaneously, the case 110 provides a load path to react against a bolt 145 in order to function the weapon in a fully automated mode.

The expanding propellant gases in this embodiment from the primary propellant charge 116 ignite the secondary propellant charge 157 directly or by initiating a secondary primer 150. Alternatively, a vent hole 300 may be used in place of the secondary primer 150 to allow ignition of the secondary propellant charge 157 directly. Another alternative uses a vent hole 300 in place of the secondary primer 150 and secondary propellant charge 157. The propellant gases from the primary propellant charge 116 bleed through the vent hole 300 and act against the wad 160 directly to face the payload 102 from the payload cup 122.

The cartridge 100 is assembled by inserting the propellant 116 and the primer 113 in the case 110. The primer 150, if used is inserted into the payload cup 122. The propellant 157, if used, is inserted into the payload cup 122. The wad 160 is installed over the propellant 157 in the payload cup 122. The payload 102 is inserted in front of the wad 160 in the payload cup 122. The payload cup 122 is inserted into the piston 104. The case 110 is assembled to the piston 104. The base 111B of the piston 104 is crimped over a flange 110F of the case 110 to secure the piston 104 and the case 110 in a telescoping relationship. The link 112 is assembled by sliding it over the piston 104. The link 112 is fitted over the shoulder 114.

Having described the general components of the cartridge 100, its operation or use will now be explained in connection with FIGS. 1–6. The use of the cartridge 100 can be separated into three general stages: feeding; chambering; and firing.

Feeding

The feeding stage is illustrated in FIGS. 1, 2. In this stage, the cartridge 100 is in the fully extended or "telescope open" position. A drive spring 131 pushes against a bolt 145, which, in turn, pushes the cartridge 100 inside the barrel 118, in the direction of the arrow F.

In the case of the 40 mm MK19 Grenade Machinegun, during the feeding stage the cartridge 100 resists telescoping in the delinking process of the weapon operation. The interface between the piston 104 and the cartridge case 110 provides a crimp 111, adhesive or other means of preventing the case 110 and piston 104 from telescoping until the cartridge 100 is chambered.

Chambering

The chambering stage is illustrated in FIGS. 3, and 4. As the cartridge 100 is chambered, the shoulder 114 contacts the rear surface or breech 119 of the barrel 118. The resistance exerted by the crimp 111 at the interface between the piston 104 and the cartridge case 110 is overcome, and the piston 104 and the cartridge case 110 telescope to the closed (or compacted) position.

The case 110 pushes the cup 122 forward. The cup 122 pierces the end of the piston 104 to create an opening expelling the piston cover 161 through which the payload 102 may now be expelled. Alternatively, the gas pressure from firing may be used to force the cup 122 forward to pierce the piston 104. The cup 122 is prevented from being ejected or expelled by the gases by a flange 162 located on the outer surface of cup 122. The flange 162 stops against a mating surface 163 on the inside of piston 104.

Firing

The firing stage is illustrated in FIGS. 5 and 6. Upon ignition of the primer 113, the propellant 116 ignites and pressurizes the cartridge 100. The shoulder 114 is restrained by the breech 119 of the barrel 118. The expanding propellant gases force the cartridge case 110 rearward in the direction of the arrow R. This, in turn, accelerates the bolt 145 to the rear and compresses the drive spring 131 for cycling the weapon. Propellant gases bled through vent 300 act on the wad 160 at the base of the payload 102 or a forward propellant charge 157 ignited directly or through a forward primer 150 by the hot, high pressure propellant gases from the primary propellant charge 116 act on the wad 160 to force the payload 102 to be expelled from the cup 122 and to be accelerated along the barrel 118 in the direction of the arrow F.

The embodiments described herein are included for the purposes of illustration, and are not intented to be the exclusive; rather, they can be modified within the scope of the invention. Other modifications may be made when implementing the invention for a particular application.

What is claimed is:

1. A low impulse cartridge for use in a weapon including a barrel, wherein the cartridge comprises:

a case;

a piston slidably disposed relative to said cartridge case;

a shoulder protruding outwardly from a periphery of said piston to provide a stop surface for the barrel when the cartridge is chambered;

a payload which is projected during firing;

means to contain the payload;

means to pierce said piston to expel said payload;

wherein said piston is in a normally telescoping open position; and wherein said piston telescopes in a closed position during chambering whereupon the barrel is forced against the shoulder, so that said shoulder provides a load path for reacting against the barrel; and wherein said piston telescopes in said open position after firing.

2. A low impulse cartridge, according to claim 1, wherein the means which contains the payload is a cylindrical cup seated within said piston.

3. A low impulse cartridge, according to claim 2, wherein said cylindrical cup also houses a second propellant charge to increase pressure and to better propel payload.

4. A low impulse cartridge according to claim 2, wherein said cylindrical cup is prevented from being ejected by the gases by a flange located in the outer surface of said cup.

5. A low impulse cartridge, according to claim 1, wherein the means to pierce said piston to expel said payload comprises a. cylindrical cup which pierces the piston cup; and b. a wad, which under gas pressure from propellant pushes out the said payload.

6. A low impulse cartridge according to claim 1, wherein said payload includes a projectile.

7. A low impulse cartridge according to claim 1, wherein said payload includes liquids, solids or powders.

8. A low impulse cartridge according to claim 1, wherein said payload includes a plurality of non-lethal rubber balls.

9. A low impulse cartridge according to claim 1, wherein said payload includes non-lethal wood or foam batons.

* * * * *